US011250983B2

(12) United States Patent
Kanbe

(10) Patent No.: US 11,250,983 B2
(45) Date of Patent: Feb. 15, 2022

(54) COIL COMPONENT

(71) Applicant: Murata Manufacturing Co., Ltd., Kyoto-fu (JP)

(72) Inventor: Yuki Kanbe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 634 days.

(21) Appl. No.: 16/134,381

(22) Filed: Sep. 18, 2018

(65) Prior Publication Data

US 2019/0088400 A1 Mar. 21, 2019

(30) Foreign Application Priority Data

Sep. 21, 2017 (JP) ..... JP2017-180774

(51) Int. Cl.

| | |
|---|---|
| ***H01F 27/24*** | (2006.01) |
| ***H01F 3/10*** | (2006.01) |
| ***H01F 17/04*** | (2006.01) |
| ***H01F 27/26*** | (2006.01) |
| ***H01F 27/28*** | (2006.01) |
| *H01F 27/29* | (2006.01) |

(52) U.S. Cl.

CPC ..... *H01F 27/24* (2013.01); *H01F 3/10* (2013.01); *H01F 17/045* (2013.01); *H01F 27/263* (2013.01); *H01F 27/2823* (2013.01); *H01F 27/292* (2013.01)

(58) Field of Classification Search

CPC ..... H01F 3/10; H01F 17/045; H01F 27/24

See application file for complete search history.

(56) References Cited

U.S. PATENT DOCUMENTS

| | | | | |
|---|---|---|---|---|
| 6,373,366 | B1 * | 4/2002 | Sato | H01F 17/045 336/192 |
| 7,567,163 | B2 * | 7/2009 | Dadafshar | H01F 27/2847 336/178 |
| 2006/0267719 | A1 * | 11/2006 | Yasuda | H01F 27/027 336/223 |
| 2008/0224813 | A1 * | 9/2008 | Hirai | H01F 17/045 336/216 |
| 2009/0195342 | A1 * | 8/2009 | Azuma | H01F 17/045 336/192 |

(Continued)

FOREIGN PATENT DOCUMENTS

| | | | | |
|---|---|---|---|---|
| EP | 1085533 | A1 * | 3/2001 | H01F 27/292 |
| JP | 2007-059807 | A | 3/2007 | |

(Continued)

OTHER PUBLICATIONS

An Office Action issued by the German Patent Office dated Oct. 1, 2020, which corresponds to German Patent Application No. 10 2018 215 946.7 and is related to U.S. Appl. No. 16/134,381 with English language translation.

*Primary Examiner* — Elvin G Enad
*Assistant Examiner* — Malcolm Barnes
(74) *Attorney, Agent, or Firm* — Studebaker & Brackett PC

(57) ABSTRACT

A bent shape that projects when viewed in an axis direction of a winding core part is given to each top surface of a first flange part and a second flange part of a drum-like core. The top surface and a lower principal surface of a plate-like core are closest to each other in a portion where a vertex of the bent shape is positioned.

20 Claims, 6 Drawing Sheets

(56) References Cited

U.S. PATENT DOCUMENTS

| | | | | |
|---|---|---|---|---|
| 2012/0133469 | A1* | 5/2012 | Tomonari | H01F 27/292<br>336/192 |
| 2018/0286554 | A1* | 10/2018 | Kojima | H01F 27/29 |
| 2019/0080834 | A1* | 3/2019 | Someya | H01F 27/2828 |
| 2020/0013545 | A1* | 1/2020 | Takahashi | H01F 27/2823 |
| 2020/0105451 | A1* | 4/2020 | Horie | H01F 27/266 |

FOREIGN PATENT DOCUMENTS

| | | | | |
|---|---|---|---|---|
| JP | 2009231547 | A | * | 10/2009 |
| JP | 2014-099587 | A | | 5/2014 |
| JP | 2014099587 | A | * | 5/2014 |

* cited by examiner

COIL COMPONENT

CROSS-REFERENCE TO RELATED APPLICATION

This application claims benefit of priority to Japanese Patent Application No. 2017-180774, filed Sep. 21, 2017, the entire content of which is incorporated herein by reference.

BACKGROUND

Technical Field

The present disclosure relates to coil components, and particularly to a coil component that includes a winding core part around which a wire is wound, a drum-like core, which includes a first flange part and a second flange part provided at respective end portions of the winding core part, and a plate-like core, which is arranged over and between the first flange part and the second flange part.

Background Art

Examples of techniques interesting for the present disclosure include Japanese Unexamined Patent Application Publication No. 2014-99587. Japanese Unexamined Patent Application Publication No. 2014-99587 describes a surface-mount type coil component that includes a drum-like core and a plate-like core.

The drum-like core includes a winding core part around which a wire is wound, and a first flange part and a second flange part provided at respective end portions of the winding core part. Each of the first flange part and the second flange part includes an inside end surface, which faces toward the winding core part and on which corresponding one of the end portions of the winding core part is positioned, an outside end surface, which faces outside and toward the side opposite the inside end surface, a bottom surface, which joins the inside end surface and the outside end surface and faces toward a mounting board when the coil component is mounted, and a top surface, which is opposite the bottom surface.

The plate-like core includes a lower principal surface and an upper principal surface, which face in directions opposite each other. The plate-like core is arranged over and between the first flange part and the second flange part and fixed to the drum-like core in this state while the lower principal surface faces the top surfaces with an adhesive interposed therebetween.

Japanese Unexamined Patent Application Publication No. 2014-99587 suggests a structure that can bring high adhesion strength between a drum-like core and a plate-like core even with a small amount of adhesive. More specifically, on the top surface of a flange part, its central portion is highest and has a flat face, and a gradient that decreases from the central portion to the end portions is caused. As a result, the top surface of the flange part and the lower principal surface of the plate-like core are in direct contact with each other without any adhesive interposed therebetween on the flat face in the central portion of the top surface and are caused to face each other with a clearance interposed therebetween, which becomes narrower from the end portions of the top surface to the central portion of the top surface, and an adhesive is arranged in the clearance. According to the techniques described in Japanese Unexamined Patent Application Publication No. 2014-99587, the gradient of the top surface of each flange part is given by an inclined plane.

According to the techniques Japanese Unexamined Patent Application Publication No. 2014-99587, a capillary phenomenon can be caused in the central portion of the top surface in the clearance and thus, the gap between the flange part and the plate-like core can be filled with the smallest possible amount of adhesive. Consequently, a relatively small amount of adhesive can bring relatively high adhesion strength between the drum-like core and the plate-like core.

In such a coil component, a plate-like core forms a closed magnetic path together with a drum-like core. In the closed magnetic path, the clearance between the plate-like core and the drum-like core serves as a magnetism gap. Accordingly, variation in the volume of the magnetism gap causes variation in the electrical characteristics of the coil, such as inductance or impedance.

In the coil component described in Japanese Unexamined Patent Application Publication No. 2014-99587, a flat face is formed in the central portion of the top surface of the flange part. The plate-like core is in direct contact with the flange part on the flat face and forms a clearance that becomes wider from the central portion to the end portions on the top surface of the flange part. The clearance serves as the above-described magnetism gap.

In manufacturing a coil component with a drum-like core and a plate-like core, a process of causing the plate-like core to adhere to the drum-like core is performed. In the process, the plate-like core needs to be arranged in a proper position in relation to the drum-like core and in some cases, however, the plate-like core is arranged in an improper position in relation to the drum-like core.

Particularly in the coil component described in Japanese Unexamined Patent Application Publication No. 2014-99587, a flat face is formed in the central portion of each flange part and a gradient that decreases from the central portion to the end portions is caused and thus, in the process of causing the plate-like core to adhere to the drum-like core, the plate-like core can adhere to the drum-like core while its lower principal surface is tilted to be almost parallel to the gradient face of the flange part. Such adhesion causes a relatively large variation in the volume of the clearance between the plate-like core and the flange part, that is, the volume of the magnetism gap, and consequently causes a large variation in the electrical characteristics of the coil, such as inductance or impedance.

SUMMARY

Accordingly, the present disclosure is aimed at providing a coil component that can widen tolerance for the positioning without allowing variation in the positioning of the plate-like core in relation to the drum-like core to affect variation in the volume of a magnetism gap.

A coil component according to preferred embodiments of the present disclosure includes a drum-like core including a winding core part, and a first flange part and a second flange part that are provided at a first end portion and a second end portion of the winding core part, respectively. The first end portion and the second end portion are opposite to each other. The coil component further includes a plate-like core including a lower principal surface and an upper principal surface that face in directions opposite to each other, and at least one wire wound around the winding core part.

Each of the first flange part and the second flange part described above includes an inside end surface that faces toward the winding core part and on which corresponding one of the first and second end portions thereof is located, an outside end surface that faces outside and toward an opposite side of the inside end surface, a bottom surface that joins the inside end surface and the outside end surface and faces toward a mounting board when the coil component is mounted, and a top surface that is opposite to the bottom surface. The plate-like core is fixed to the first flange part and the second flange part with an adhesive interposed therebetween while the lower principal surface of the plate-like core faces the top surfaces of the first flange part and the second flange part.

To address the above-described technical problems, in the coil component with such a structure according to a first aspect of the present disclosure, the top surfaces of the first flange part and the second flange part each have a first bent shape that projects when viewed in an axis direction of the winding core part, and each top surface and the lower principal surface are closest to each other in a portion where a vertex of the first bent shape is located. The first bent shape serves to keep the total volume of the magnetism gap approximately constant even when the inclination of the plate-like core in relation to the flange parts varies.

Preferably, when viewed from the respective top surfaces toward the respective bottom surfaces of the first flange part and the second flange part, each first bent shape is given at least in a range where the winding core part is located and more preferably, given to the entire top surface. Thus, when the first bent shape is given to a wider range of the top surface, the range of the inclination of the plate-like core in relation to the flange parts that can keep the total volume of the magnetism gap approximately constant can be further widened.

Preferably, the top surface and the lower principal surface form a minute clearance in a portion where a vertex of the first bent shape is located, the minute clearance allowing the adhesive to penetrate therein. In this structure, the magnetism gap is formed all over the top surface and accordingly, in comparison with a case where the top surface and the lower principal surface are in direct contact in the portion where the top surface and the lower principal surface of the plate-like core are closest to each other, deviation of a magnetic flux can be inhibited while enhancing direct current superposition characteristics. A dimension of the minute clearance is preferably about 1 μm or more and about 3 μm or less (i.e., from about 1 μm to about 3 μm).

In the first aspect of the present disclosure, preferably, when viewed in the axis direction of the winding core part, the first bent shape is an arc shape with a curvature radius r, and the curvature radius r is larger than a width-direction dimension W of the plate-like core viewed in the axis direction of the winding core part. Thus, when the curvature radius r of the arc shape with the first bent shape is larger than the width-direction dimension W of the plate-like core when viewed in the axis direction of the winding core part, variation in the total volume of the magnetism gap caused by variation in the inclination of the plate-like core in relation to the flange parts can be further reduced.

In the first aspect of the present disclosure, preferably, the top surface has a second bent shape that projects when viewed in a direction in which the lower principal surface of the plate-like core extends and which is perpendicular to the axis direction of the winding core part. By giving the second bent shape in addition to the first bent shape to each top surface as described above, the region in which the vertex of the first bent shape is present can be restricted in a specific position in the thickness direction of each flange part. As a result, the vertex of the first bent shape also serves as the vertex of the second bent shape.

According to the above-described structure, even when variation in the drum-like core in the manufacturing process causes each height dimension of the flange parts, which corresponds to the distance between the top surface and the bottom surface of each flange part to differ between the first flange part and the second flange part, the position in which the top surface of each flange part and the lower principal surface of the plate-like core are closest to each other can be maintained on the vertex of the first bent shape or in the vicinity thereof. Accordingly, even when a difference in height occurs between the first flange part and the second flange part, the length of a magnetic path formed in the drum-like core and the plate-like core can be kept approximately constant and variation in inductance can be inhibited.

In the above-described preferred embodiment, preferably, a vertex of the second bent shape is located closer to the side of the outside end surface than a face that is parallel to the outside end surface and passes through a midpoint of a line segment that connects the inside end surface and the outside end surface. In this structure, even when a difference in height between the first flange part and the second flange part further increases, the position in which the top surface of each flange part and the lower principal surface of the plate-like core are closest to each other can be maintained on the vertex of the second bent shape or in the vicinity thereof.

In the first aspect of the present disclosure, the lower principal surface of the plate-like core may include a recessed portion that surrounds and accepts the top surface of corresponding one of the first flange part and the second flange part. In this structure, leakage of a magnetic flux can be reduced and as a result, inductance can be enhanced.

Although in the above-described first aspect, a projecting bent shape is given to each top surface of the first flange part and the second flange part, similar effect is expectable when a similar shape is given to the side of the lower principal surface of the plate-like core opposite to the top surfaces.

According to a second aspect of the present disclosure, the lower principal surface of the plate-like core has a bent shape that projects when viewed in an axis direction of the winding core part and each top surface and the lower principal surface of the plate-like core are closest to each other in a portion where a vertex of the bent shape is located.

Since in the coil component according to preferred embodiments of the present disclosure, a bent shape is given to at least one of the top surface of each flange part of the drum-like core and the lower principal surface of the plate-like core, which are opposite to each other, even when the inclination of the plate-like core in relation to the flange parts varies, the total volume of the magnetism gap can be kept approximately constant and thus, variation in inductance caused by variation in the magnetism gap can be reduced.

Further, in a process of causing the plate-like core to adhere to the drum-like core in manufacturing the coil component, the necessity to strictly control the posture of the plate-like core in relation to the drum-like core can be reduced. Accordingly, load in process control can be reduced and as a result, reduction in manufacturing costs for the coil component is expectable.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 1A is a front view and FIG. 1B is a left side view;

FIG. 5A illustrates the coil component illustrated in FIG. 4 and FIG. 5B illustrates a related-art coil component;

DETAILED DESCRIPTION

Figure 1A:
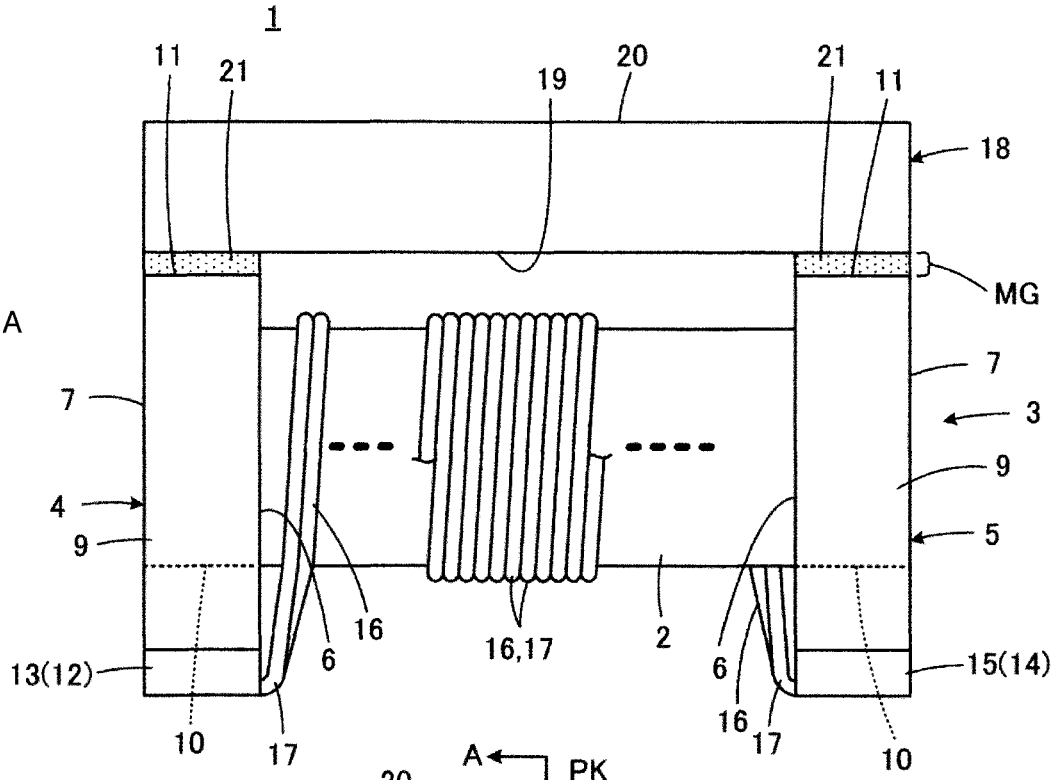
FIGS. 1A and 1B illustrate a coil component according to a first embodiment of the present disclosure, where
Figure 1B:
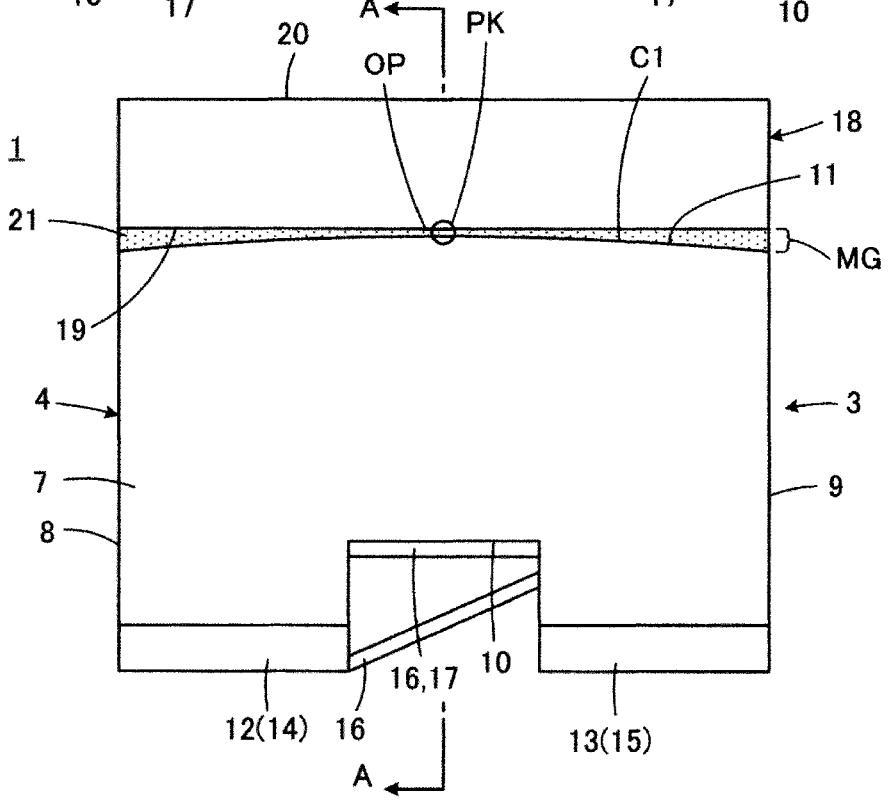

By referring to FIGS. 1A and 1B, a coil component 1 according to a first embodiment of the present disclosure is described. The illustrated coil component 1 constitutes a common mode choke coil for example.

The coil component 1 includes a drum-like core 3 including a winding core part 2. The drum-like core 3 includes a first flange part 4 and a second flange part 5 respectively provided at a first end portion and a second end portion of the winding core part 2, which are opposite each other. The drum-like core 3 is made from an electrical insulative material and more specifically, a magnetic substance, such as NiZn ferrite, a metal amorphous material, or resin containing magnetic powder. For example, the winding core part 2, the first flange part 4, and the second flange part 5 of the drum-like core 3 are each shaped like a substantially quadrangular prism with a cross section that is approximately rectangular.

Each of the first flange part 4 and the second flange part 5 includes an inside end surface 6, which faces toward the winding core part 2 and on which corresponding one of the end portions of the winding core part 2 is positioned, and an outside end surface 7, which is opposite the inside end surface 6 and faces outside. Each of the first flange part 4 and the second flange part 5 joins the inside end surface 6 and the outside end surface 7 and includes a first side surface 8 and a second side surface 9, which face in directions opposite each other. Further, each of the first flange part 4 and the second flange part 5 includes a bottom surface 10, which joins the inside end surface 6 and the outside end surface 7 while joining the first side surface 8 and the second side surface 9 and faces toward a mounting board when the coil component is mounted, and a top surface 11, which is opposite the bottom surface 10. Although in the illustrated embodiments, the inside end surface 6 is parallel to the outside end surface 7, the inside end surface 6 may be inclined in relation to the outside end surface 7.

The bottom surface 10 of the first flange part 4 is provided with terminal electrodes 12 and 13. The bottom surface 10 of the second flange part 5 is provided with the terminal electrodes 14 and 15. The respective bottom surfaces 10 of the first flange part 4 and the second flange part 5 form projecting step portions in the positions where terminal electrodes 12 to 15 are provided.

In FIG. 1A, the terminal electrodes 12 and 14 are positioned behind the terminal electrodes 13 and 15 to be covered by the terminal electrodes 13 and 15, respectively, and in FIG. 1B, the terminal electrodes 14 and 15 are positioned behind the terminal electrodes 12 and 13 to be covered by the terminal electrodes 12 and 13, respectively. To express these positional relationships in the drawings, in FIGS. 1A and 1B, the references given to the terminal electrodes that are positioned to be covered are indicated with brackets.

Typically, the terminal electrodes 12 to 15 are formed by baking a conductive paste. For example, the terminal electrodes 12 to 15 are formed by coating a conductive paste with a conductive constituent that is silver and baking the conductive paste at a peak temperature of about 700° C. Instead of baking a conductive paste, the terminal electrodes 12 to 15 may be provided by causing terminal hardware made of conductive metal to adhere to the first flange part 4 and the second flange part 5.

The terminal electrodes 12 to 15 undergo plating when necessary. As the plating, for example, electrolytic plating is performed to sequentially form a Ni plating film with a thickness of about 3 μm and a Sn plating film with a thickness of about 16 μm or sequentially form a Cu plating film with a thickness of about 5 μm, a Ni plating film with a thickness of about 3 μm, and a Sn plating film with a thickness of about 16 μm.

Around the winding core part 2, for example, two wires 16 and 17 are wound in the same direction in a spiral. The wires 16 and 17 are each constituted by for example, a copper wire on which insulation coating with polyurthane or polyester imide is performed. The wires 16 and 17 are each wound by about 30 turns for example, and when necessary, wound into a multilayer. A first end of the first wire 16 is connected to the terminal electrode 12 and a second end opposite the first end of the first wire 16 is connected to the terminal electrode 14. A first end of the second wire 17 is connected to the terminal electrode 13 and a second end opposite the first end of the second wire 17 is connected to the terminal electrode 15. For example, thermal pressure bonding is applied to the connection between the terminal electrodes 12 to 15 and the wires 16 and 17. To the thermal pressure bonding, a heating temperature of about 510° C. is applied for example.

The coil component 1 further includes a plate-like core 18, which is arranged over and between the first flange part 4 and the second flange part 5. The plate-like core 18 forms a closed magnetic path together with the drum-like core 3. Similar to the drum-like core 3, the plate-like core 18 is also made from an electrical insulative material and more specifically, a magnetic substance, such as ferrite, a metal amorphous material, or resin containing magnetic powder. The plate-like core 18 includes a lower principal surface 19 and an upper principal surface 20 that face in directions opposite each other. The plate-like core 18 is fixed to the first flange part 4 and the second flange part 5 with an adhesive 21 interposed therebetween while the lower principal surface 19 faces the respective top surfaces 11 of the first flange part 4 and the second flange part 5. The adhesive 21 used is made from for example, thermosetting epoxy resin and the fixing between the plate-like core 18 and the first flange part 4 and the second flange part 5 is achieved by hot pressing of about 10 minutes at about 150° C.

A distinctive structure of the coil component 1 is described below.

In focusing attention on the top surface 11 of the first flange part 4, as clearly illustrated in FIG. 1B, a projecting bent shape C1 is found when viewed in the axis direction of the winding core part 2. Thus, in a portion where a vertex PK of the bent shape C1 is positioned, the top surface 11 and the lower principal surface 19 of the plate-like core 18 are closest to each other. In the present embodiment, the bent shape C1 is shaped like an arc and given all over the top surface 11.

The top surface 11 of the first flange part 4 and the lower principal surface 19 of the plate-like core 18 form a minute clearance OP where the adhesive 21 can penetrate in a portion where the vertex PK of the bent shape C1 is positioned. In this structure, a magnetism gap MG with the adhesive 21 filled all over the top surface 11 is formed and accordingly, in comparison with a case where the top surface 11 and the lower principal surface 19 are in direct contact in the portion where the top surface 11 and the lower principal surface 19 are closest to each other, deviation of a magnetic flux can be inhibited while enhancing direct current superposition characteristics. A dimension of the minute clearance OP is preferably about 1 μm or more and about 3 μm or less (i.e., from about 1 μm to about 3 μm). The above-described distinctive structure on the side of the first flange part 4 is also employed on the side of the second flange part 5.

Figure 2A:
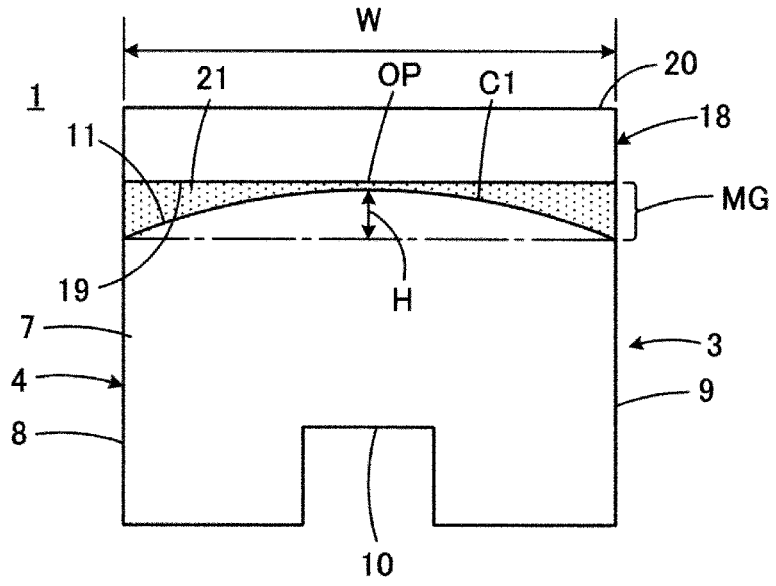
FIGS. 2A and 2B are schematic diagrams for describing variation a magnetism gap caused by the inclination of a plate-like core in the coil component illustrated in FIGS. 1A and 1B.
Figure 2B:
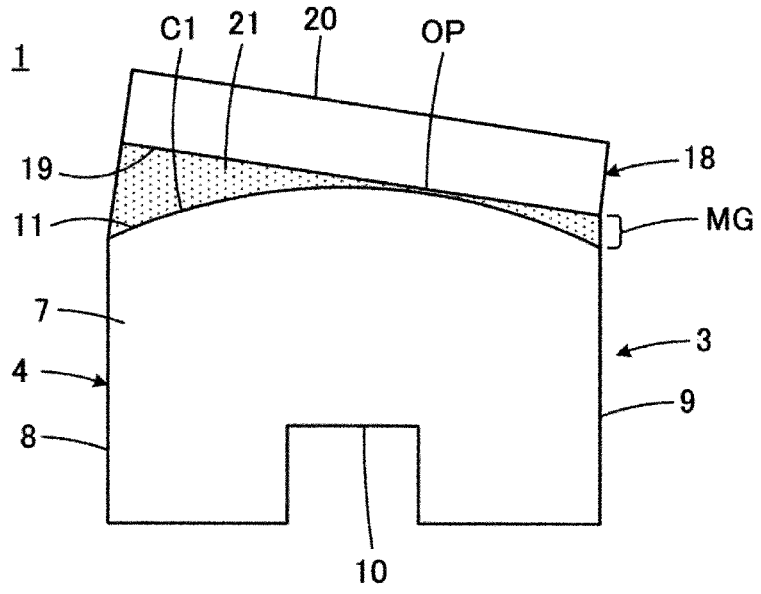

The above-described bent shape C1 acts so that the total volume of the magnetism gap MG can be kept approximately constant even when the inclination of the plate-like core 18 in relation to the first flange part 4 and the second flange part 5 varies. This action is described by referring to FIGS. 2A and 2B. While illustrating the coil component 1 from the same direction as the direction from which FIG. 1B illustrates the coil component 1, FIGS. 2A and 2B each illustrate the bent shape C1 by further exaggerating the curvature thereof. In FIGS. 2A and 2B, similar references are given to the elements that correspond to the elements illustrated in FIG. 1B.

In FIGS. 2A and 2B, FIG. 2A illustrates a state in which the plate-like core 18 is fixed to the drum-like core 3 without being inclined and FIG. 2B illustrates a state in which the plate-like core 18 is fixed to the drum-like core 3 while being inclined. The description below is made with regard to the side of the first flange part 4 illustrated in FIGS. 2A and 2B. Although not described, the structure achieved on the side of the second flange part 5 is similar to that on the side of the first flange part 4.

When attention is focused on the magnetism gap MG where the adhesive 21 is filled by referring to FIGS. 2A and 2B, it is found that the total volume of the magnetism gap MG can be kept approximately constant even when the inclination of the plate-like core 18 in relation to the flange part 4 varies.

More specifically, in FIG. 2A, the magnetism gap MG has a volume approximately equal on each side with the minute clearance OP present therebetween. In the state in which the plate-like core 18 is inclined rightward as illustrated in FIG. 2B, in comparison with the state in FIG. 2A, the volume of the magnetism gap MG is increased on the left side of the minute clearance OP while the volume of the magnetism gap MG is decreased on the right side of the minute clearance OP. That is, as the volume of the magnetism gap MG increases on the left side of the minute clearance OP, the volume of the magnetism gap MG decreases on the right side of the minute clearance OP so as to compensate the increase. The similar applies to the state in which the plate-like core 18 is inclined leftward.

Accordingly, because of the bent shape C1 given to the respective top surfaces 11 of the first flange part 4 and the second flange part 5 of the drum-like core 3, even when the inclination of the plate-like core 18 in relation to the first flange part 4 and the second flange part 5 varies, the total volume of the magnetism gap MG can be kept approximately constant. Thus, variation in inductance caused by variation in the magnetism gap MG can be reduced.

As described above, the advantage that even when the inclination of the plate-like core 18 in relation to the first flange part 4 and the second flange part 5 varies, the total volume of the magnetism gap MG can be kept approximately constant can be exerted more certainly when a condition below is satisfied. That is, the condition is that when viewed in the axis direction of the winding core part 2, the bent shape C1 is shaped like an arc with a curvature radius r and the curvature radius r is larger than a width-direction dimension W of the plate-like core 18 when viewed in the axis direction of the winding core part 2 (see FIG. 2A). Thus, when the curvature radius r of the arc with the bent shape C1 is larger than the width-direction dimension W of the plate-like core 18 when viewed in the axis direction of the winding core part 2, variation in the total volume of the magnetism gap MG caused by variation in the inclination of the plate-like core 18 in relation to the first flange part 4 and the second flange part 5 can be further decreased.

For example, a height dimension H of the bent shape C1 is preferably about 2 μm or more and about 10 μm or less and the curvature radius r of the bent shape C1 is preferably about 70 mm or more and about 400 mm or less (i.e., from about 70 mm to about 400 mm). In this case, the bent shape C1 is formed so as to make the adhesion between the plate-like core 18 and the first flange part 4 and the second flange part 5 favorable.

In addition, as described above, even when the inclination of the plate-like core 18 in relation to the first flange part 4 and the second flange part 5 varies, the total volume of the magnetism gap MG can be kept approximately constant and accordingly, variation in inductance caused by variation in the magnetism gap MG can be reduced. Thus, in a process of causing the plate-like core 18 to adhere to the drum-like core 3 in manufacturing the coil component 1, the necessity to strictly control the posture of the plate-like core 18 in relation to the drum-like core 3 can be reduced. Accordingly, load in process control can be reduced and as a result, reduction in manufacturing costs for the coil component 1 is expectable.

Figure 3:
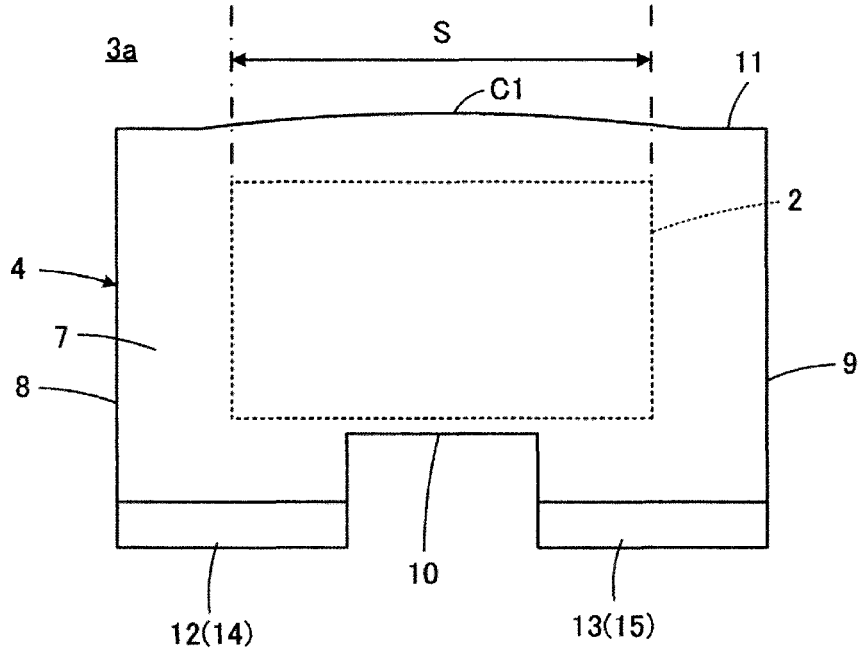
FIG. 3 is a left side view illustrating a drum-like core of a coil component according to a second embodiment of the present disclosure, which corresponds to FIG. 1B.

Next, by referring to FIG. 3, a coil component according to a second embodiment of the present disclosure is described. FIG. 3 illustrates a drum-like core 3*a* of the coil component according to the second embodiment in a left side view corresponding to FIG. 1B. In FIG. 3, similar references are given to the elements corresponding to those illustrated in FIG. 1B and overlapping descriptions are omitted.

In the drum-like core 3 illustrated in FIG. 1B, the bent shape C1 is given to all of the top surface 11 as described above. Thus, when the bent shape C1 is given to a wider range of the top surface 11, the range of the inclination of the plate-like core 18 in relation to the first flange part 4 and the second flange part 5 that can keep the total volume of the magnetism gap MG approximately constant can be further widened.

When diminishing of the above-described advantages is allowed to some extent, however, the bent shape C1 may be given to for example, only part of the top surface 11 as illustrated in FIG. 3 instead of being given to all of the top surface 11. In the drum-like core 3*a* illustrated in FIG. 3, a bent shape C1 is given to a range S where at least a winding core part 2 is positioned when viewed from top surfaces 11 toward bottom surfaces 10 of a first flange part 4 and a second flange part 5. The embodiment illustrated in FIG. 3 can also secure the range of the inclination of the plate-like core 18 (see FIGS. 1A and 1B) in relation to the first flange part 4 and the second flange part 5 enough to keep the total volume of a magnetism gap approximately constant to an extent of causing no practical problem.

Figure 4:
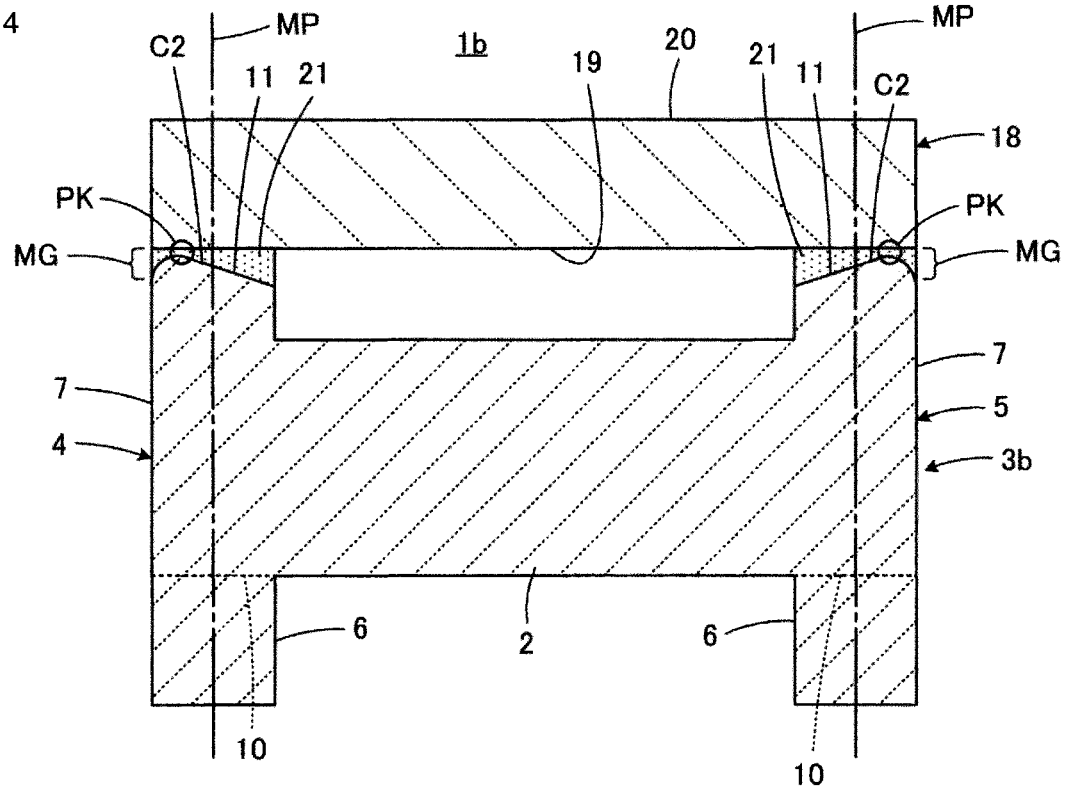
FIG. 4 illustrates a cross section of a coil component according to a third embodiment of the present disclosure, which corresponds to the cross section along line A-A in FIG. 1B, where the illustration of a wire wound around a winding core part is omitted.

Next, by referring to FIG. 4, a coil component 1*b* according to a third embodiment of the present disclosure is described. FIG. 4 illustrates a cross section of the coil component 1*b*, which corresponds to the cross section along line A-A in FIG. 1B. FIG. 4 omits the illustration of wires wound around a winding core part 2. In FIG. 4, similar references are given to the elements corresponding to those illustrated in FIGS. 1A and 1B and overlapping descriptions are omitted.

The coil component 1*b* according to the third embodiment has a distinctive structure described below in addition to the distinctive structure of the first embodiment or the second embodiment described above.

When viewed in the direction in which the lower principal surface 19 of the plate-like core 18 extends and that is perpendicular to the axis direction of the winding core part 2, a projecting second bent shape C2 is given to the respective top surfaces 11 of a first flange part 4 and a second flange part 5 of a drum-like core 3*b*. To distinguish the second bent shape C2 from the above-described bent shape C1, the bent shape C1 is hereinafter referred to as the "first bent shape C1."

As described above, by giving the second bent shape C2 to the top surface 11 in addition to the first bent shape C1, as illustrated in FIG. 3, the region in which the vertex PK of the first bent shape C1 is present is restricted in a specific position in the thickness direction of each of the first flange part 4 and the second flange part 5. Accordingly, the vertex PK not only serves as the vertex of the first bent shape C1 but also serves as the vertex of the second bent shape C2.

Figure 5A:
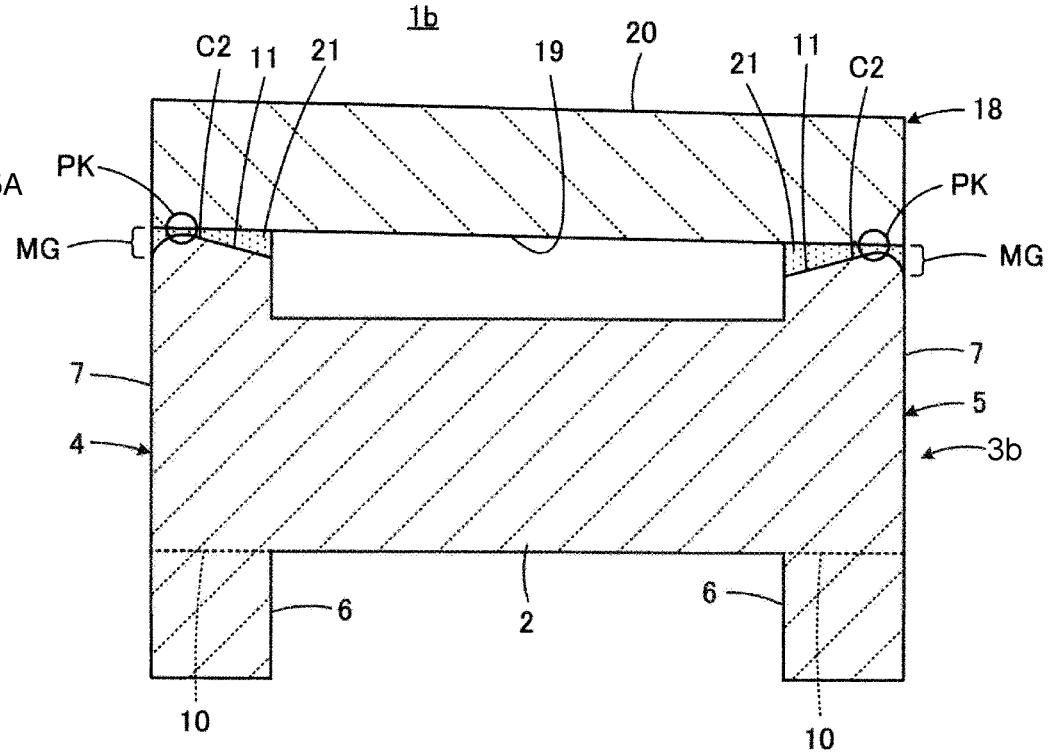
FIGS. 5A and 5B are cross-sectional views similar to FIG. 4 for describing advantages brought by the coil component illustrated in FIG. 4, where
Figure 5B:
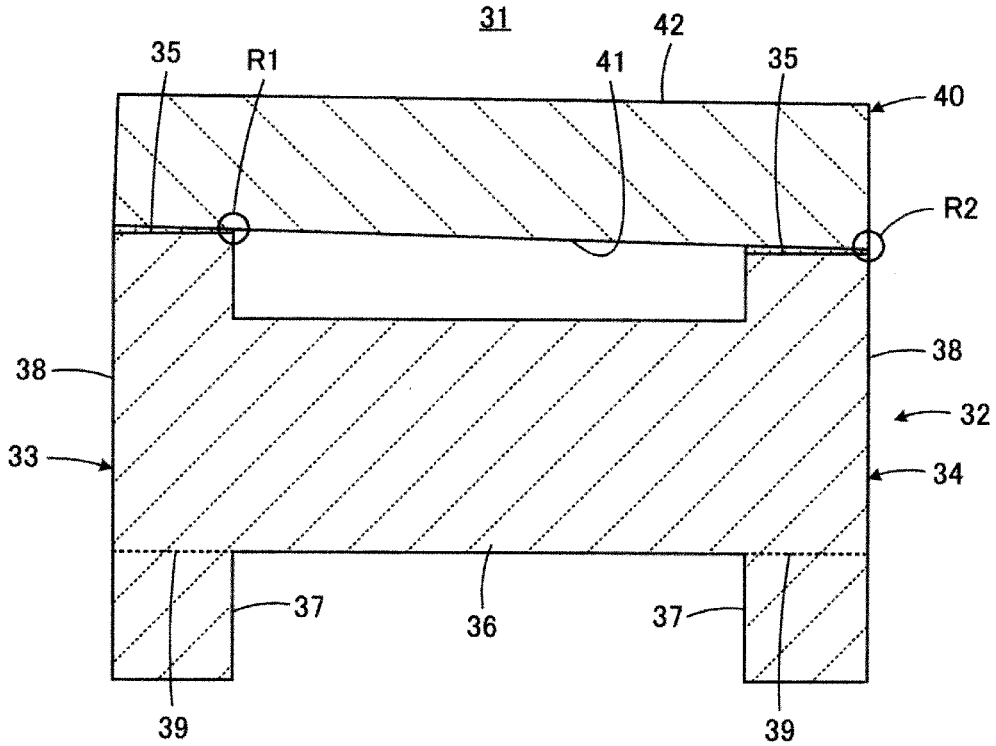

Advantages brought by the second bent shape C2 are now described by referring to FIGS. 5A and 5B. FIGS. 5A and 5B are cross-sectional views similar to FIG. 4, where FIG. 5A illustrates the coil component 1*b* illustrated in FIG. 4 and FIG. 5B illustrates a related-art coil component 31.

Because of variation in the drum-like core 3*b* in manufacture, each height dimension of the first flange part 4 and the second flange part 5, which corresponds to the distance between the top surface 11 and the bottom surface 10 of each of the first flange part 4 and the second flange part 5, may differ between the first flange part 4 and the second flange part 5. In FIG. 5A, the height dimension of the second flange part 5 is shorter than the height dimension of the first flange part 4. Even in such a case, the position in which each top surface 11 of the first flange part 4 and the second flange part 5 and the lower principal surface 19 of the plate-like core 18 are closest to each other can be maintained on the vertices PK of the first bent shape C1 and the second bent shape C2 or in the vicinity thereof. Accordingly, even when a difference in height occurs between the first flange part 4 and the second flange part 5, the length of a magnetic path formed in the drum-like core 3*b* and the plate-like core 18 can be kept approximately constant and variation in inductance can be inhibited.

Although in FIG. 5A, the height dimension of the second flange part 5 is shorter than the height dimension of the first flange part 4, the similar can apply to a case where the height dimension of the second flange part 5 is longer than the height dimension of the first flange part 4.

In contrast, it is assumed that in a drum-like core 32 of the related-art coil component 31, a difference in height occurs between a first flange part 33 and a second flange part 34 and for example, as illustrated in FIG. 5B, the height dimension of the second flange part 34 is shorter than the height dimension of the first flange part 33. A bent shape is given to neither of respective top surfaces 35 of the flange parts 33 and 34 and flat faces are merely formed.

Similar to the drum-like core 3*b* illustrated in FIG. 5A, the related-art drum-like core 32 illustrated in FIG. 5B includes a winding core part 36 that joins the first flange part 33 and the second flange part 34. In addition to the above-described top surface 35, each of the first flange part 33 and the second flange part 34 includes an inside end surface 37, which faces toward the winding core part 36 and on which corresponding one of end portions of the winding core part 36 is positioned, an outside end surface 38, which faces outside and toward the opposite side of the inside end surface 37, and a bottom surface 39, which joins the inside end surface 37 and the outside end surface 38 and faces toward a mounting board when the coil component is mounted.

Similar to the plate-like core 18 illustrated in FIG. 5A, a plate-like core 40 includes a lower principal surface 41 and an upper principal surface 42 that face in directions opposite each other.

The state that is described below is brought when in the related-art coil component 31 illustrated in FIG. 5B, the plate-like core 40 is arranged over and between the first flange part 33 and the second flange part 34 and is fixed to the first flange part 33 and the second flange part 34 with an adhesive 43 interposed therebetween while the lower principal surface 41 of the plate-like core 40 faces the respective top surfaces 35 of the first flange part 33 and the second flange part 34.

In relation to the first flange part 33, the lower principal surface 41 of the plate-like core 40 is closest to the top surface 35 in a ridge line portion R1 where the top surface 35 and the inside end surface 37 come into contact and in relation to the second flange part 34, is closest to the top surface 35 in a ridge line portion R2 where the top surface 35 and the outside end surface 38 come into contact. Accordingly, on the side of the first flange part 33, a magnetic path passing near the ridge line portion R1 is primary and on the side of the second flange part 34, a magnetic path passing near the ridge line portion R2 is primary.

When although not illustrated, the first flange part 33 and the second flange part 34 have no difference in height, the lower principal surface 41 of the plate-like core 40 is equally close to all of the top surface 35 in relation to each of the first flange part 33 and the second flange part 34. Thus, on both the side of the first flange part 33 and the side of the second flange part 34, the magnetic path passing near the ridge line portion R1 is primary. Accordingly, depending on a difference in height between the first flange part 33 and the second flange part 34, the lengths of the magnetic paths passing through the drum-like core 32 and the plate-like core 40 vary and as a result, variation in inductance occurs.

The third embodiment is distinct in that as illustrated in FIG. 4, the vertex PK of the second bent shape C2 is positioned closer to the side of the outside end surface 7 than a face MP that is parallel to the inside end surface 6 and the outside end surface 7 of each of the first flange part 4 and the second flange part 5 and passes through the midpoint of a line segment that connects the inside end surface 6 and the outside end surface 7. In this structure, even when a difference in height between the first flange part 4 and the second flange part 5 further increases, the position in which each top surface 11 of the first flange part 4 and the second flange part 5 and the lower principal surface 19 of the plate-like core 18 are closest to each other can be maintained on the vertex PK of the second bent shape C2 or in the vicinity thereof.

Figure 6:
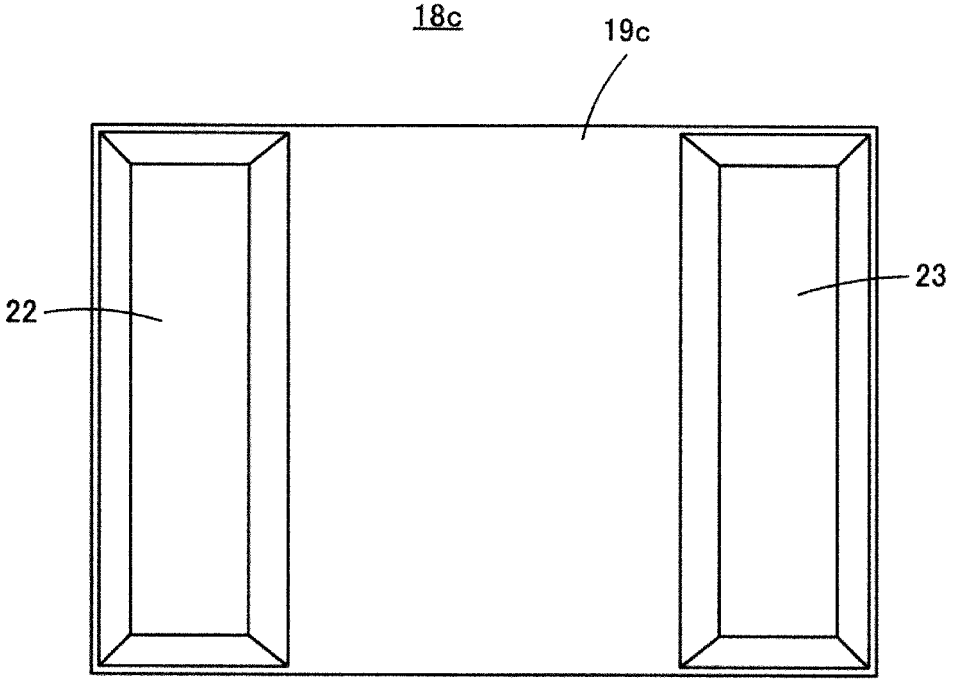
FIG. 6 illustrates a lower principal surface of a plate-like core of a coil component according to a fourth embodiment of the present disclosure.

Next, by referring to FIG. 6, a coil component according to a fourth embodiment of the present disclosure is described. FIG. 6 illustrates a lower principal surface 19*c* of a plate-like core 18*c* of the coil component according to the fourth embodiment of the present disclosure.

The fourth embodiment is distinctive in the form of the plate-like core 18*c*. That is, the lower principal surface 19*c* of the plate-like core 18*c* is provided with recessed portions 22 and 23 that surround and accept respective top surfaces 11 (see FIGS. 1A and 1B) of a first flange part 4 and a second flange part 5. The recessed portions 22 and 23 each include an opening face larger than each top surface 11 of the first flange part 4 and the second flange part 5. In this structure, leakage of a magnetic flux can be reduced and as a result, inductance can be enhanced.

Although in the illustrated plate-like core 18*c*, one of the recessed portions described above, 22, solely accepts the first flange part 4 and the other recessed portion, 23, solely accepts the second flange part 5, the two recessed portions 22 and 23 may be replaced with a single recessed portion that surrounds and accepts both the first flange part 4 and the second flange part 5.

Although in the above-described embodiments, a projecting bent shape is given to each top surface of the first flange part and the second flange part, as in the embodiments that follow below, similar effect is expectable when a similar shape is given to the side of the lower principal surface of the plate-like core opposite the top surfaces.

Figure 7:
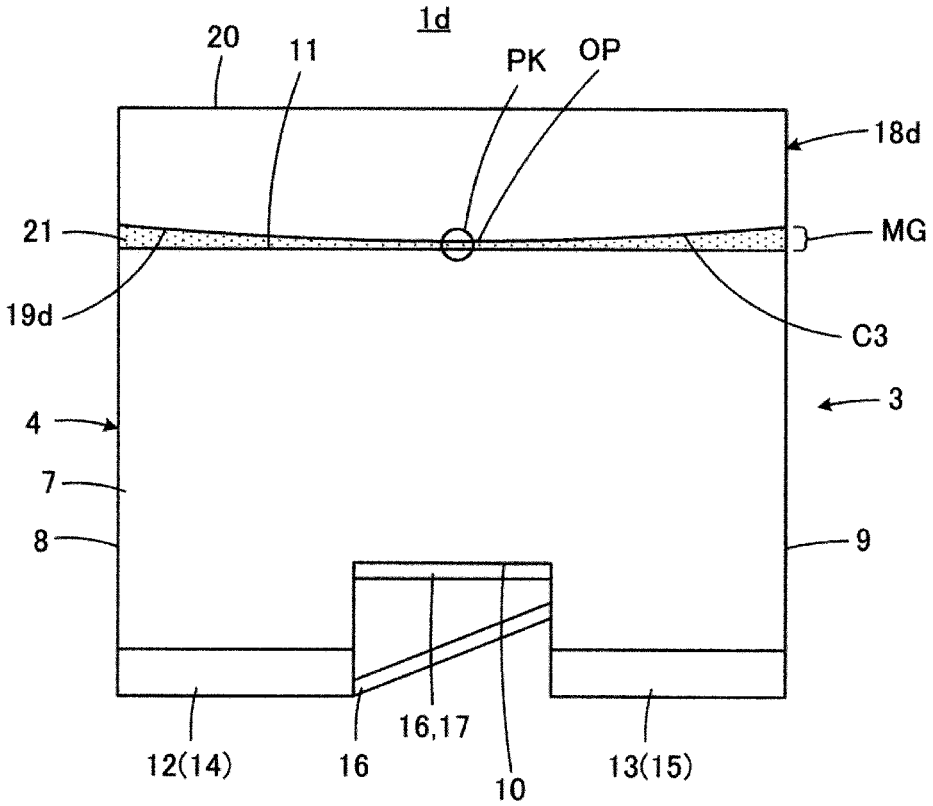
FIG. 7 is a left side view illustrating a coil component according to a fifth embodiment of the present disclosure, which corresponds to FIG. 1B.

Next, by referring to FIG. 7, a fifth embodiment of the present disclosure is described. FIG. 7 illustrates a coil component 1*d* according to the fifth embodiment in a left side view corresponding to FIG. 1B. In FIG. 7, similar references are given to the elements corresponding to those illustrated in FIG. 1B and overlapping descriptions are omitted.

In the coil component 1*d* illustrated in FIG. 7, a lower principal surface 19*d* of a plate-like core 18*d* has a bent shape C3 that projects when viewed in the axis direction of a winding core part 2 (see FIGS. 1A and 1B). As a result, in a portion where a vertex PK of the bent shape C3 is positioned, a top surface 11 of a first flange part 4 and the lower principal surface 19*d* are closest to each other. In the present embodiment, the bent shape C3 is shaped like an arc and given all over the lower principal surface 19*d*.

The top surface 11 of the first flange part 4 and the lower principal surface 19*d* of the plate-like core 18*d* form a minute clearance OP where an adhesive 21 can penetrate in a portion where the vertex PK of the bent shape C3 is positioned. Such a distinctive structure on the side of the first flange part 4 is also employed on the side of a second flange part 5.

Figure 8:
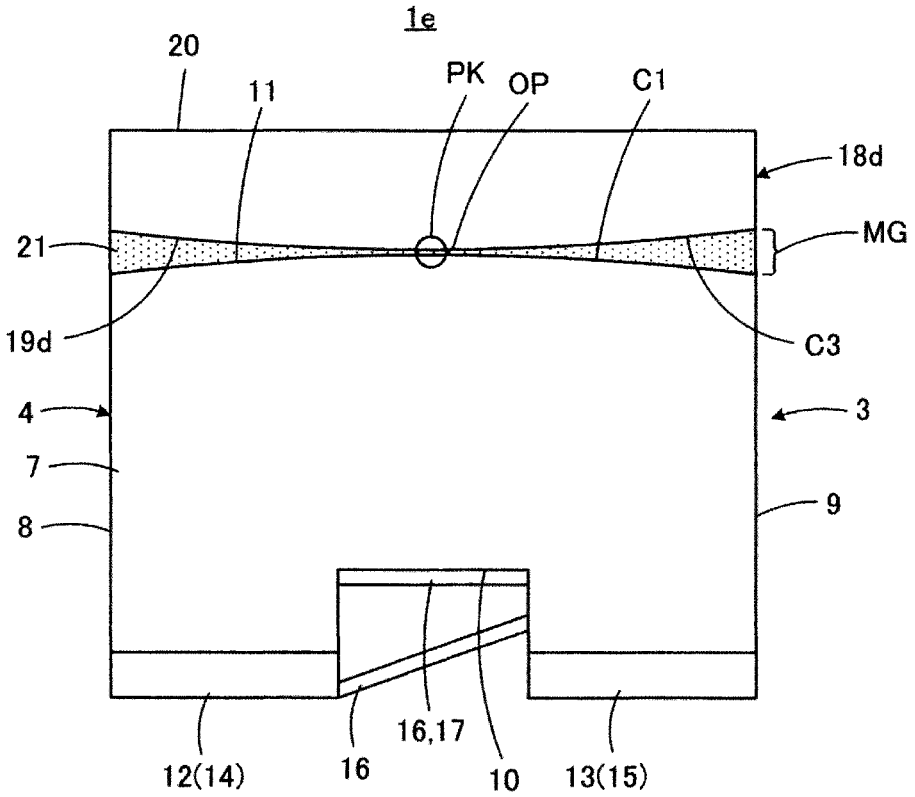
FIG. 8 is a left side view illustrating a coil component according to a sixth embodiment of the present disclosure, which corresponds to FIG. 1B.

Next, by referring to FIG. 8, a coil component according to a sixth embodiment of the present disclosure is described. FIG. 8 illustrates a coil component 1*e* according to the sixth embodiment in a left side view corresponding to FIG. 1B or FIG. 7. In FIG. 8, similar references are given to the elements corresponding to those illustrated in FIG. 1B or FIG. 7 and overlapping descriptions are omitted.

In the coil component 1*e* illustrated in FIG. 8, similar to the above-described fifth embodiment, a lower principal surface 19*d* of a plate-like core 18*d* has a bent shape C3 that projects when viewed in the axis direction of a winding core part 2 (see FIGS. 1A and 1B). Further, in the coil component 1*e*, similar to the above-described first embodiment, a top surface 11 of a first flange portion 4 has a bent shape C1 that projects when viewed in the axis direction of the winding core part 2. When viewed from the top surface 11 toward the bottom surface 12 of the first flange part 4, a vertex PK of the bent shape C3 is superposed over a vertex PK of the bent shape C1 in the same position as that of the vertex PK of the bent shape C1. As a result, in the portion where the respective vertices PK of the bent shapes C3 and C1 are positioned, the top surface 11 and the lower principal surface 19*d* of the plate-like core 18*d* are closest to each other.

The top surface 11 of the first flange part 4 and the lower principal surface 19*d* of the plate-like core 18*d* form a minute clearance OP where an adhesive 21 can penetrate in the portion where the vertices PK of the bent shapes C3 and C1 are positioned. Such a distinctive structure on the side of the first flange part 4 is also employed on the side of a second flange part 5.

Although the present disclosure is described above in relation to the illustrated embodiments, other variations are possible within the scope of the present disclosure.

Although each of the coil components 1, 1*b*, 1*d*, and 1*e* in the above-described embodiments constitutes a common mode choke coil for example, the coil component may constitute a single coil or may constitute another transformer or balun. Thus, the number of wires may be one or be three or more and according to the number of wires, the number of terminal electrodes provided on each flange part can be changed.

In configuring the coil component according to the present disclosure, partial replacements or combinations of the elements are possible between different ones of the embodiments described herein.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-like core including:

a winding core part, and a first flange part and a second flange part that are provided at a first end portion and a second end portion of the winding core part, respectively, the first end portion and the second end portion being opposite to each other;

a plate-like core including a lower principal surface and an upper principal surface that face in directions opposite to each other; and at least one wire wound around the winding core part, each of the first flange part and the second flange part including:

an inside end surface that faces toward the winding core part and on which corresponding one of the first and second end portions of the winding core part is located, an outside end surface that faces outside and toward an opposite side of the inside end surface, a bottom surface that joins the inside end surface and the outside end surface and faces toward a mounting board when the coil component is mounted, and a top surface that is opposite to the bottom surface, the plate-like core being fixed to the first flange part and the second flange part with an adhesive interposed therebetween while the lower principal surface of the plate-like core faces the top surfaces of the first and second flange parts, the top surfaces of the first flange part and the second flange part each having a first bent shape that projects when viewed in an axis direction of the winding core part, and each of the top surfaces and the lower principal surface being closest to each other without contacting each other in a portion where a vertex of the first bent shape is located.

2. The coil component according to claim 1, wherein when viewed from the respective top surfaces toward the respective bottom surfaces of the first flange part and the second flange part, each first bent shape is at least in a range where the winding core part is located.

3. The coil component according to claim 2, wherein the first bent shape is given to an entirety of each of the top surfaces.

4. The coil component according to claim 1, wherein the top surface and the lower principal surface form a minute clearance in a portion where a vertex of the first bent shape is located, the minute clearance allowing the adhesive to penetrate therein.

5. The coil component according to claim 4, wherein a dimension of the minute clearance is from 1 μm to 3 μm.

6. The coil component according to claim 1, wherein when viewed in the axis direction of the winding core part, the first bent shape is an arc shape with a curvature radius, and the curvature radius is larger than a width-direction dimension of the plate-like core when viewed in the axis direction of the winding core part.

7. The coil component according to claim 1, wherein the top surface has a second bent shape that projects when viewed in a direction in which the lower principal surface of the plate-like core extends and which is perpendicular to the axis direction of the winding core part.

8. The coil component according to claim 7, wherein a vertex of the second bent shape is located closer to a side of the outside end surface than a face that is parallel to the outside end surface and passes through a midpoint of a line segment that connects the inside end surface and the outside end surface.

9. The coil component according to claim 1, wherein the lower principal surface of the plate-like core includes a recessed portion that surrounds and accepts the top surface of corresponding one of the first flange part and the second flange part.

10. The coil component according to claim 2, wherein the top surface and the lower principal surface form a minute clearance in a portion where a vertex of the first bent shape is located, the minute clearance allowing the adhesive to penetrate therein.

11. The coil component according to claim 3, wherein the top surface and the lower principal surface form a minute clearance in a portion where a vertex of the first bent shape is located, the minute clearance allowing the adhesive to penetrate therein.

12. The coil component according to claim 2, wherein when viewed in the axis direction of the winding core part, the first bent shape is an arc shape with a curvature radius, and the curvature radius is larger than a width-direction dimension of the plate-like core when viewed in the axis direction of the winding core part.

13. The coil component according to claim 3, wherein when viewed in the axis direction of the winding core part, the first bent shape is an arc shape with a curvature radius, and the curvature radius is larger than a width-direction dimension of the plate-like core when viewed in the axis direction of the winding core part.

14. The coil component according to claim 4, wherein when viewed in the axis direction of the winding core part, the first bent shape is an arc shape with a curvature radius, and the curvature radius is larger than a width-direction dimension of the plate-like core when viewed in the axis direction of the winding core part.

15. The coil component according to claim 5, wherein when viewed in the axis direction of the winding core part, the first bent shape is an arc shape with a curvature radius, and the curvature radius is larger than a width-direction dimension of the plate-like core when viewed in the axis direction of the winding core part.

16. The coil component according to claim 2, wherein the top surface has a second bent shape that projects when viewed in a direction in which the lower principal surface of the plate-like core extends and which is perpendicular to the axis direction of the winding core part.

17. The coil component according to claim 3, wherein the top surface has a second bent shape that projects when viewed in a direction in which the lower principal surface of the plate-like core extends and which is perpendicular to the axis direction of the winding core part.

18. The coil component according to claim 2, wherein the lower principal surface of the plate-like core includes a recessed portion that surrounds and accepts the top surface of corresponding one of the first flange part and the second flange part.

19. The coil component according to claim 3, wherein the lower principal surface of the plate-like core includes a recessed portion that surrounds and accepts the top surface of corresponding one of the first flange part and the second flange part.

20. A coil component comprising:

a drum-like core including:

a winding core part, and a first flange part and a second flange part that are provided at a first end portion and a second end portion of the winding core part, respectively, the first end portion and the second end portion being opposite to each other;

a plate-like core including a lower principal surface and an upper principal surface that face in directions opposite to each other; and at least one wire wound around the winding core part, each of the first flange part and the second flange part including:

an inside end surface that faces toward the winding core part and on which corresponding one of the first and second end portions of the winding core is located, an outside end surface that faces outside and toward an opposite side of the inside end surface, a bottom surface that joins the inside end surface and the outside end surface and faces toward a mounting board when the coil component is mounted, and a top surface that is opposite to the bottom surface, the plate-like core being fixed to the first flange part and the second flange part with an adhesive interposed therebetween while the lower principal surface of the plate-like core faces the top surfaces of the first and second flange parts, the lower principal surface of the plate-like core having a bent shape that projects when viewed in an axis direction of the winding core part, each of the top surfaces and the lower principal surface being closest to each other in a portion where a vertex of the bent shape is located, and the bent shape of the lower principal surface extends entirely between opposite edges of the plate-like core in a direction transverse to the axis direction of the winding core part.

* * * * *